United States Patent [19]

Fawcett

[11] Patent Number: 4,862,819

[45] Date of Patent: Sep. 5, 1989

[54] WHEEL DRIVE

[75] Inventor: Derek J. Fawcett, Emsworth, England

[73] Assignee: Nautech, Ltd., England

[21] Appl. No.: 174,041

[22] Filed: Mar. 28, 1988

[30] Foreign Application Priority Data

Mar. 27, 1987 [GB] United Kingdom ..... 8707371

[51] Int. Cl.[4] ..... B63H 25/04

[52] U.S. Cl. ..... 114/144 R; 114/144 E; 114/146

[58] Field of Search ..... 114/144 R, 144 E, 144 A, 114/146; 74/494; 180/146, 79.1

[56] References Cited

U.S. PATENT DOCUMENTS 2,448,778 9/1948 Crise ..... 114/144 R
3,003,363 10/1961 De Hart ..... 74/494
4,170,953 10/1979 Pounder et al. ..... 114/144 E
4,262,618 4/1981 Vanderzee ..... 114/144 R

*Primary Examiner*—Sherman D. Basinger
*Attorney, Agent, or Firm*—Cushman, Darby & Cushman

[57] ABSTRACT

A wheel drive for a boat steering wheel comprises a front drivable ring for clamping to the spokes of the wheel, and a driving part including an autopilot-controlled motor supported on a rear ring that is itself supported on the front ring by a series of circumferential rollers engaging a grooved path around the front ring. A torque reaction engagement between the rear ring and an adjacent object prevents rotation of the driving part so that the motor can drive the front ring and the wheel in rotation by means of a drive belt. The engagement does not carry the weight of the driving part, which forms a self-contained unit with the drivable part.

12 Claims, 5 Drawing Sheets

WHEEL DRIVE

FIELD OF THE INVENTION

This invention relates to a motor drive for driving a steering wheel, particularly that of a boat such as a yacht or motor boat.

BACKGROUND OF THE INVENTION

It is known to drive a steering wheel from e.g. an automatic pilot by means of a belt passing round a pulley connected coaxially to the wheel and around a drive pulley driven by the motor of the automatic pilot, which is mounted on some fixed object adjacent the wheel e.g. a bulkhead or the steering column.

This system has the disadvantage that it is essentially not selfcontained, the driven pulley and belt being separate from the driving components.

SUMMARY OF THE INVENTION

The invention proposes a wheel drive including a drivable part, preferably a circular member such as a ring, that can be fixed to the steering wheel so as to rotate with it, and a driving part including a drive motor that is supported by the drivable part fixed to the steering wheel but has means for engaging a torque reaction point provided on an adjacent object in order to prevent it from rotating with the wheel. A drive coupling such as a belt enables the motor to drive the drivable part and hence the wheel in rotation.

The drivable part and driving part may thus constitute a self-contained unit that is substantially entirely supported on the wheel with the torque reaction engagement allowing the wheel to be driven but not provided for manually disengaging the drive belt from the motor in order that, for example, steering may temporarily be done manually. Particularly when the driving and drivable parts comprise respective rings mounted coaxially together, they may define between them a cavity enclosing the drive coupling or a substantial part thereof. Where the drive is by belt, for example, the drum surface engaged by the belt, the belt itself and also a drive pulley of the motor that drives the belt, are preferably all in the cavity between the two parts and substantially enclosed to protect them from fouling and damage.

It is preferred that the torque reaction engagement with the reaction point on an adjacent object, to prevent rotation of the drive part with the wheel and to provide reaction for the drive, is adapted to allow a degree of radial movement of the drive part relative to the wheel axis. This is because there may not always be perfect axial alignment between the drive assembly and the wheel itself. The radial freedom may be achieved by having a projection on the adjacent object received in a radially-extending slot provided on the drive part, or vice versa. To provide the necessary torque the reaction point or points should be spaced from the wheel axis.

BRIEF DESCRIPTION OF THE DRAWINGS

By way of example a preferred embodiment of the invention will now be described in detail with reference to the accompanying drawings, in which.

DETAILED DESCRIPTION OF THE PREFERRED EMBODIMENTS

Figure 1:
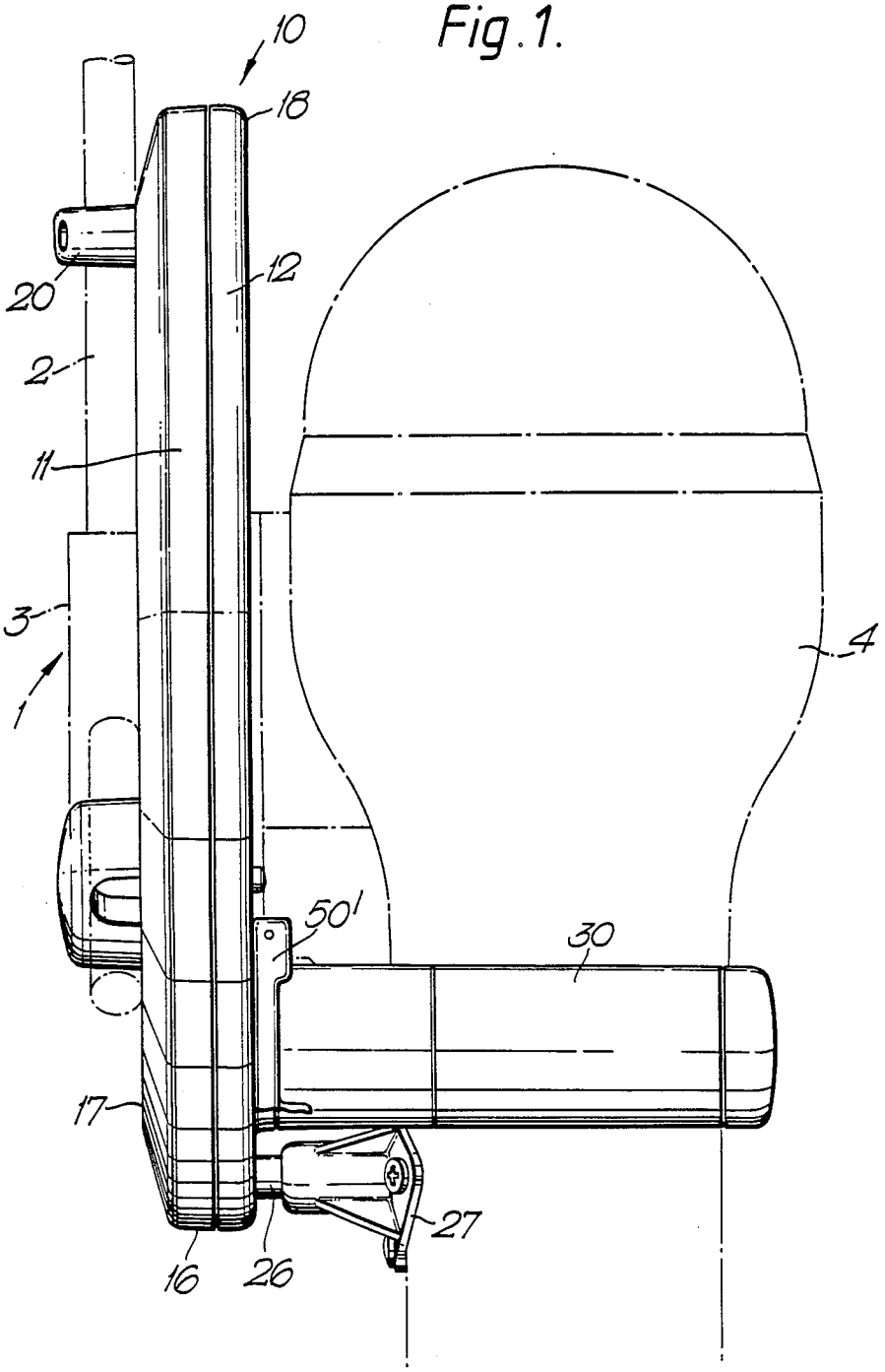
FIG. 1 is a side view of a wheel drive installed on the wheel helm of a boat (shown partially)
Figure 2:
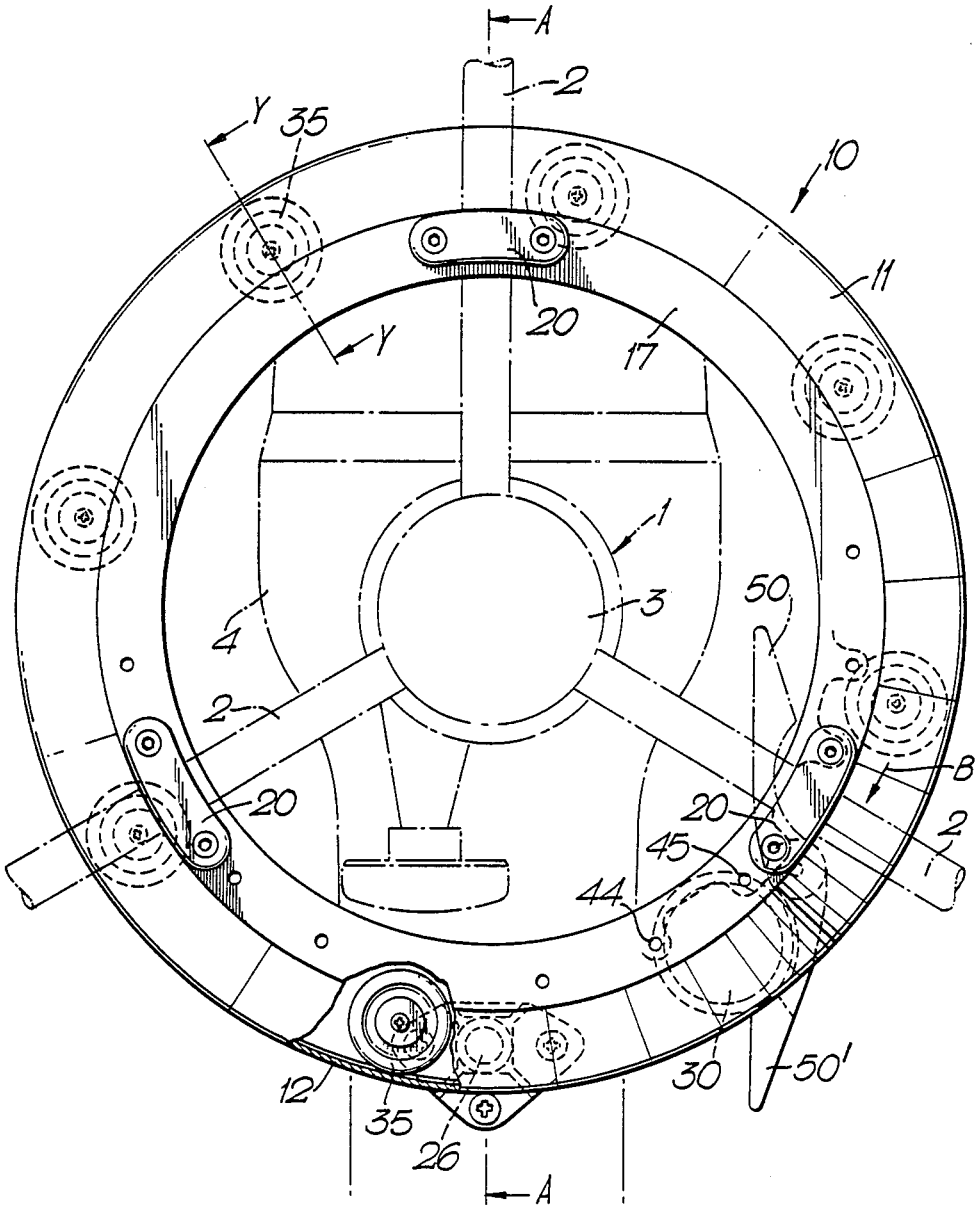
FIG. 2 is a face view of the wheel drive.
Figure 3:
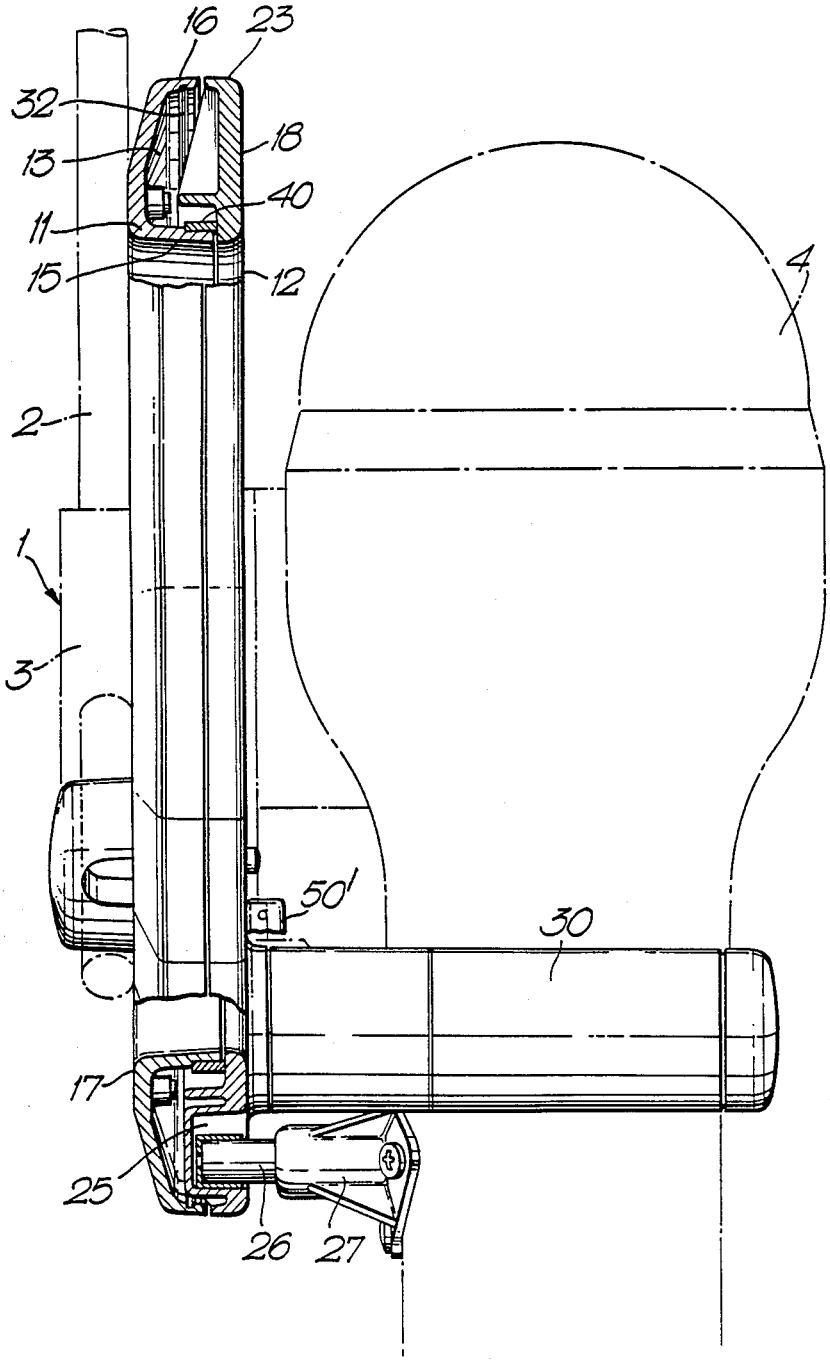
FIG. 3 is a side view similar to FIG. 1, but showing the wheel drive sectioned along the line A—A of FIG. 2.

Looking firstly at FIGS. 1 and 2, the wheel helm of a boat comprises a wheel 1 (shown only partially here) having three spokes 2 extending radially from a hub 3 mounted rotatably with its axis horizontal towards the top of a pedestal 4 which is itself mounted on the deck of the boat (not shown). The pedestal 4 serves to mount the wheel 1 at a convenient height and to house the mechanism connecting it to the rudder of the boat. Between the pedestal 4 and the wheel 1, and clamped to the spokes 2 of the latter so as to be coaxial with it, is a generally ring-shaped wheel drive 10. Referring now also to FIG. 3, this comprises a circular front ring 11 and a circular rear ring 12 between which an annular cavity 13 is defined around the drive 10. The front ring 11 is of a shallow U-shaped cross-section with the inner and outer limbs of the U pointing towards the pedestal 4 and defining a substantially cylindrical inner wall 15 and outer wall 16 of the drive 10. The base of the U includes a flat portion defining a flat front radial wall 17 of the front ring 11. This front wall 17 is clamped against the spokes 2 of the wheel by arched lugs 20 positioned over the spokes 2 and screwed by their ends to the front wall 17 of the front ring 11. The front ring 11 is thus constrained to rotate with the wheel 1.

The rear ring 12 has the same general diameter and radial extent as the front ring 11 but has a somewhat shallower cross-section defined by a flat rear radial wall 18, with a short outer circumferential flange 23 that extends slightly forwardly, so as nearly to abut the rearwardly-facing edges of the limbs of the front ring 11, thus defining the internal cavity 13 between the rings. At the lowest point of the rear wall 18 of the rear ring 12 there is a hole around which the material of the ring 12 projects inwardly to form an oval hole or slot 25 in which is received a metal pin 26 that projects axially forwardly from the pedestal 4. Screwed to the front of the pedestal 4, opposite the slot 25 on the rear ring 12, is a cast part 27 with a circular socket in which the metal pin 26 is held to extend axially forwardly into the oval slot 25. The slot 25 is substantially of the same width as the pin 26 so the rear ring 12 cannot move horizontally in relation to the pedestal 4 and is thereby restrained from rotation.

Also mounted rigidly on the rear ring 12 towards its lower part is a motor of an autopilot device 30, the cylindrical casing of which projects axially rearwardly from the rear ring 12 past one side of the pedestal 4. The autopilot constitutes a control system for the drive and works on the known autopilot principle, including a direction sensing mechanism coupled to the motor 30 for driving the steering of the boat so as to maintain a predetermined heading. The motor of the autopilot drives a drive pulley 51 (see FIGS. 6 and 7) located in the lower part of the cavity 13 between the two limbs of the front ring 11 with its axis parallel to the axis of the wheel 1. The drive pulley functions when necessary to drive the front ring 11 and hence the wheel 1 in rotation relative to the rear ring 12 and pedestal 4.

Figure 4:
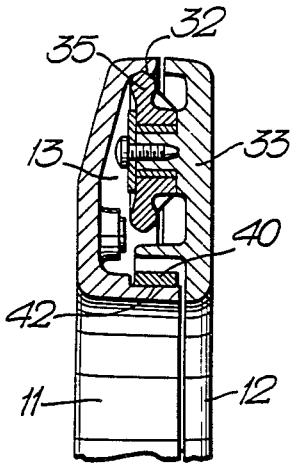
FIG. 4 is a sectional view of the wheel drive taken at Y—Y of FIG. 2.
Figure 5:
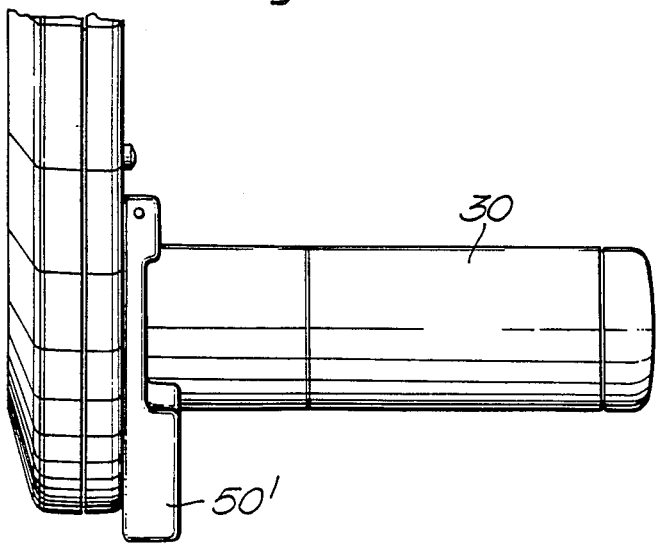
FIG. 5 is a view along arrow B in FIG. 2 of a motor arrangement of the wheel drive.

To explain this the engagement between the front and rear rings 11,12 will now be described in more detail. Referring to FIGS. 2,3 and 4 it will be seen that the outside wall 16 of the front ring 11 has a circumferential groove 32 extending right around its inner surface. At seven positions about its circumference the rear ring 12 has thickened, reinforced portions 33 in its rear wall 18 and on each of these a roller 35 is mounted. Each roller 35 is disc-shaped with a tapering edge and is mounted, with its axis of rotation parallel to the axis of the wheel 1, so that its edge engages and rolls in the groove 32 around the front ring 11. By this arrangement the two rings 11,12 can rotate freely relative to one another because the rollers 35 are free to turn, but the engagement of the rollers in the groove 32 prevents the two rings 11,12 from falling apart axially. One or more of the rollers 35 may be adapted for movement out of engagement with the groove 32 to enable separation of the front and rear rings 11,12 when desired.

The drive from the drive pulley of the motor to the front ring 11 is by means of a belt 40 that extends around the cavity 13 between the front and rear rings, making contact with a substantially smooth drum surface 42 on the inner wall 15 of the front ring 11. The belt 40 makes contact with the drum surface 42 of the ring 11 all the way round except immediately adjacent the drive pulley, where it is guided away from the drum surface 42 and around the drive pulley by a pair of guide rollers 52,54 whose axes are indicated at 44 and 45 in FIGS. 6 and 7. The inner surface of the belt 40 is provided with a series of projections and recesses (not shown) and these engage corresponding recesses and projections on the drive pulley 51.

Figure 6:
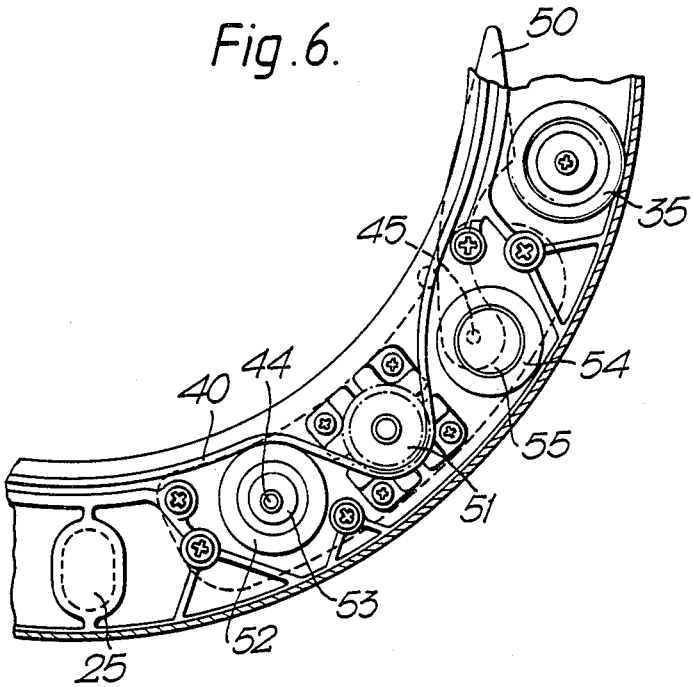
FIGS. 6 and 7 are cutaway details showing a drive engagement, in disengaged and engaged positions respectively.
Figure 7:
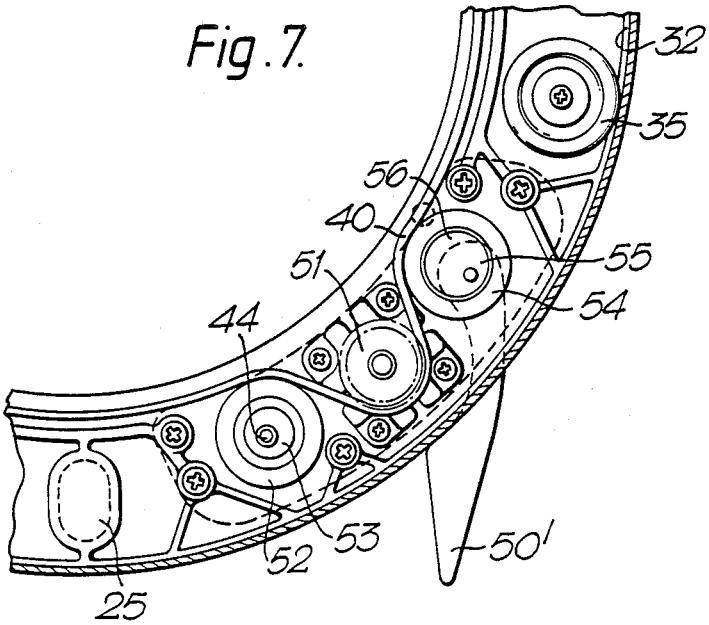

Pivoted into the rear ring 12 adjacent the autopilot is a disengaging handle 50 which, when pivoted from the inner to the outer of the two positions indicated in FIGS. 2,6 and 7 releases belt tension on the drum surface 42 so that the autopilot can no longer drive the front ring 11 and wheel 1. Details of this are seen in FIGS. 6 and 7. On one side of the drive pulley 51 a first guide roller 52 is mounted on axis 44 on an eccentric bush 53. Alteration of the angle of this bush moves the roller 52 slightly (see dot-dash lines) causing adjustment in the working tension of the belt 40 to allow for manufacturing tolerances.

A guide roller 54 on the other side of the pulley 51 is mounted on axis 45 by another eccentric bush 55, this being of much higher eccentricity than bush 53 and being constrained to rotate with the handle 50. In the condition seen in FIG. 6 the minimum radius of the bush 55 lies between the axis 45 and the belt 40. The belt 40 is now essentially slack, although in some cases a slight tension may be maintained on the belt, just enough to continue to urge the handle 50 to the position shown in this Figure.

In the condition shown in FIG. 7 the handle 50 has been brought to position 50'. This causes the roller 54 to exert substantial tension on the belt 40. It is however some 20° overcentre, that is to say past the attitude at which the maximum radius 56 of the bush 55 would be normal to the relaxed line of the belt 40. Therefore the tension of the belt 40 has the effect of biassing the roller and handle to be held in the engaged position.

It will be seen that in this arrangement the entire weight of the drive is taken by the mounting of the wheel 1, since the pin and slot arrangement 25,26 does not take any weight.

The operation of the drive is as follows. In response to signals from the direction finder of the autopilot the motor 30 of the autopilot drives the drive pulley in the appropriate direction. The belt 40, led around the drive pulley 51 by the two guide rollers 52,54, drives the front ring 11 and wheel 1 in rotation in the appropriate direction, while the slot 25 provides by engagement with the pin 26 a reaction point to prevent rotation of the rear ring 12. If the drive 10 has not been mounted exactly coaxially with the wheel 1 it will oscillate slightly as the wheel 1 turns; the vertical component of this oscillation can be taken up by movement of the pin 26 along the slot 25, while the horizontal component produces only a slight fluctuation in the speed at which the wheel 1 is driven.

The engagement between the toothed surface of the driving belt 40 and the drum surface 42 of the front ring 11 is purely frictional, so that if the drive 10 is subjected to excessive loads e.g. in heavy seas, these parts can slip over one another to prevent stresses and possible damage occurring. Should it be desired to disengage the autopilot and steer manually this can be done by throwing the lever 50.

It will be apparent that the particular drive mechanism described is not the only one which can be used. For example, the motor could drive a gear or pinion to engage a corresponding rack provided around the ring clamped to the wheel; in this case it would be desirable to provide a slip clutch in the motor gearbox to allow uncoupling under heavy loads.

I claim:

1. A motor-powered wheel drive for operating a boat steering wheel rotatably supported on a mount by a wheel axle defining a wheel axis, comprising:

a drive part having a drive motor, a drivable part, the drivable part comprising an open ring and securing means for securing the drivable part substantially coaxially to the wheel, around the wheel axle between the wheel and the mount thereof, to rotate therewith;

a drive coupling for applying drive from the drive motor to the ring of the drivable part to drive it and hence the wheel in rotation;

control means for controlling the drive motor to drive the wheel so as to steer a predetermined heading;

means for mounting the driving part on the ring of the drivable part, to be supported thereby with the drivable part rotatable relative to the driving part; and means on the driving part for making a torque reaction engagement with an adjacent object to restrain the driving part from rotation about the wheel axis.

2. A wheel drive as clamped in claim 1 wherein the means mounting the driving part on the ring of the drivable part engage around a circle, and comprise retaining engagement means for holding said parts together axially while permitting said relative rotation.

3. A wheel drive as claimed in claim 2 wherein said retaining engagement means comprise a plurality of rollers on one said driving part and said ring and a circular path on the other for engagement by the rollers.

4. A wheel drive as claimed in claim 1 wherein the driving part comprises a ring mounted to the ring of the drivable part in coaxial opposition thereto.

5. A wheel drive as claimed in claim 1 wherein the driving part and ring of the drivable part define between them a substantially closed annular cavity, and the drive coupling is enclosed in the cavity.

6. A wheel drive as claimed in claim 1 wherein means for making the torque reaction engagement between the driving part and the adjacent object comprise axial projection means radially spaced from the wheel axis for engagement in a corresponding opening.

7. A wheel drive as claimed in claim 1 wherein the means for making the torque reaction engagement between the driving part and the adjacent object comprise means for accommodating relative radial movement therebetween.

8. A wheel drive as claimed in claim 1 wherein the drive motor has a drive pulley, the ring has a drum surface and the drive coupling comprises a belt for engaging the drive pulley and drum surface to transmit drive to the ring.

9. A wheel drive as claimed in claim 1, further comprising a manually operable clutch mechanism for at least partially disengaging a drive coupling between the driving part and the ring.

10. An improved motor-powered wheel drive for a boat, the drive comprising a driving part having a drive motor, a drivable part adapted to rotate with the wheel, a drive coupling for transmitting drive from the motor to the drivable part to drive the drivable part in rotation, and an automatic pilot control system operatively associated with the drive motor for causing the boat to steer a predetermined heading;

the improvement residing in the drivable part comprising a first ring with means for screwing the ring substantially coaxially to the wheel, the driving part comprising a second ring of substantially similar diameter to the first ring and mounted coaxially thereon, one ring having plural retaining engagement rollers spaced therearound and the other ring having a circumferential path for engagement by the rollers to hold the rings together axially with the driving part supported on the drivable part and the drivable part rotatable relative to the driving part, the automatic pilot and drive motor being fixed to the second ring to be supported therewith and the drive part having means for making a torque reaction engagement with an adjacent object to restrain it from rotation with the wheel.

11. An improved wheel drive as claimed in claim 10 wherein a substantially closed annular cavity is defined between the first and second rings, and the drive coupling comprises a belt, with a drive pulley on the motor and a drive surface of the first ring adapted for driving engagement by the belt, enclosed in said cavity.

12. An improved wheel drive as claimed in claim 11, further comprising a clutch mechanism for disengaging the drive coupling, the clutch mechanism comprising a manually pivotable clutch handle and a guide roller reversibly movable by the clutch handle to engage the drive coupling belt and adjust it between an engaged condition wherein the guide rollers is urged against the belt to put it under substantial tension, and a disengaged condition wherein the guide roller is relatively withdrawn to reduce the belt tension and thereby uncoupled the drive.

* * * * *